United States Patent [19]

Barrington

[11] 4,109,724

[45] Aug. 29, 1978

[54] OIL WELL TESTING VALVE WITH LIQUID SPRING

[75] Inventor: Burchus Q. Barrington, Duncan, Okla.

[73] Assignee: Halliburton Company, Duncan, Okla.

[21] Appl. No.: 846,075

[22] Filed: Oct. 27, 1977

[51] Int. Cl.[2] ..... E21B 43/12

[52] U.S. Cl. ..... 166/315; 137/DIG. 7; 166/321; 251/62

[58] Field of Search ..... 166/315, 319, 321, 324; 251/62, 63, 63.4, 63.5, 63.6; 137/DIG. 7

[56] References Cited

U.S. PATENT DOCUMENTS

| | | | |
|---|---|---|---|
| 3,431,985 | 3/1969 | Bowen | 173/119 |
| 3,664,415 | 5/1972 | Wray et al. | 166/0.5 |
| 3,782,461 | 1/1974 | Watkins | 166/72 |
| 3,786,865 | 1/1974 | Tausch et al. | 251/58 |
| 3,786,866 | 1/1974 | Tausch et al. | 251/58 |
| 3,842,913 | 10/1974 | Mott | 166/314 |
| 3,850,250 | 11/1974 | Holden et al. | 166/315 |
| 3,856,085 | 12/1974 | Holden et al. | 166/264 |
| 3,856,085 | 12/1974 | Holden et al. | 166/264 |
| 3,870,104 | 3/1975 | Mott | 166/208 |
| 3,915,228 | 10/1975 | Giebeler | 251/62 |

*Primary Examiner*—James A. Leppink
*Attorney, Agent, or Firm*—Floyd A. Gonzalez; John H. Tregoning

[57] ABSTRACT

A testing valve and its method of operation is disclosed for use in testing an oil well formation wherein the valve includes a liquid spring and operating means for operating the valve responsive to changes in the well annulus pressure. Volume adjusting mechanisms are also disclosed for compensation for a change in the volume of liquid as the valve is subjected to pressure and temperature gradients of the well as the tool is lowered in a well to testing depth.

15 Claims, 7 Drawing Figures

OIL WELL TESTING VALVE WITH LIQUID SPRING

BACKGROUND OF THE INVENTION

Figure 1:
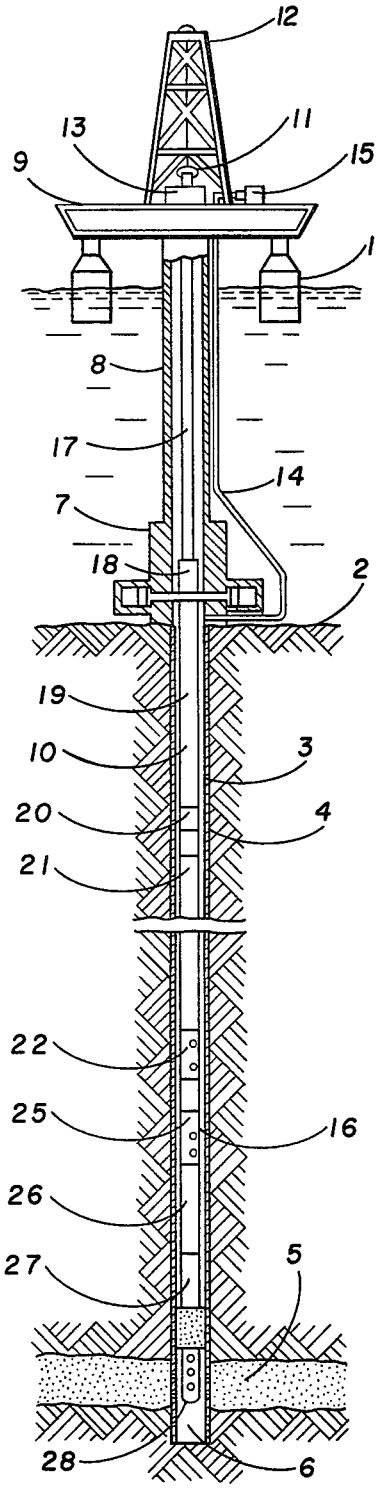
Figure 3A:
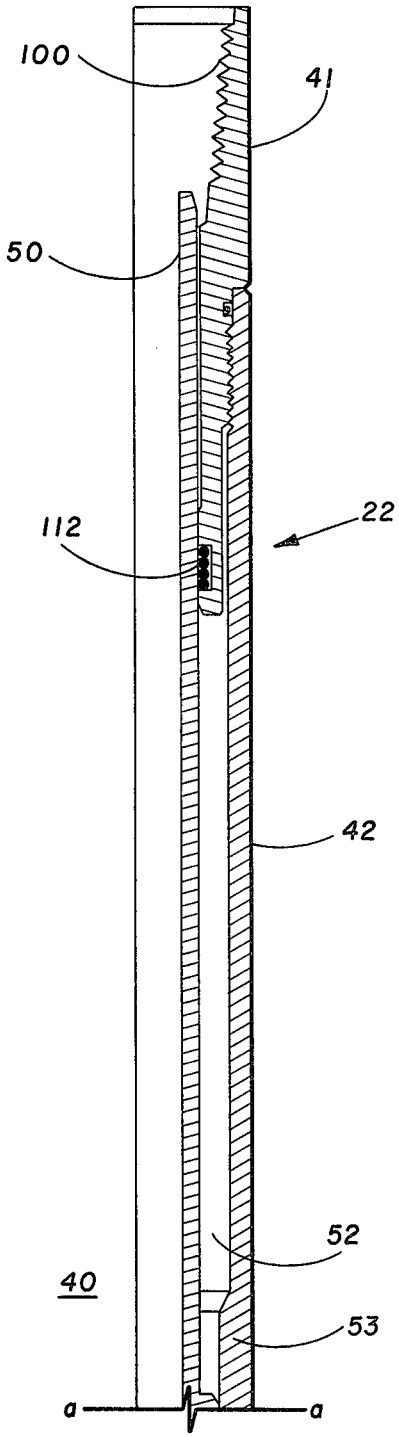

This invention relates to a valve for providing fluid communication between the interior of a tubing string in an oil well and the well annulus surrounding the tubular string. More particularly, the apparatus relates to a circulation valve for use in a testing program for a submerged oil well.

Circulation valves are known for use in a testing program in an oil well wherein the circulation valve opens after a predetermined number of incremental movements. These incremental movements are caused by an increase in annulus pressure wherein the annulus pressure is exerted against a piston to compress an inert gas in the apparatus for supplying a return spring force.

Such a circulation valve is disclosed in U.S. Pat. No. 3,850,250 issued Nov. 26, 1974 to Holden et al. and assigned to the assignee of the present invention.

Other valves for use in an oil well are known wherein the valves are operated by changing the pressure differential between the pressure in the annulus of the well and that pressure present in a flow channel in the interior of the tubing string.

The use of a compressible liquid to provide spring force for use in industrial applications is also known.

Disclosed is an oil well apparatus having a circulation valve section for moving from a closed condition to an open condition after a set number of incremental movements. The apparatus includes an outer tubular housing and an inner slidable power mandrel assembly with a power piston between the outer housing and the power mandrel assembly. Well annulus pressure is communicated to one side of the power piston and a compressible liquid is communicated from a spring chamber to the other side of the power piston.

As the apparatus is lowered into the well bore, the volume of the compressible liquid may change in response to changes in the pressure and temperature in the well bore. A ratchet mechanism is provided in one embodiment for allowing the power mandrel assembly to move in a first direction as the compressible liquid expands without moving the circulation valve section provided in the tool. When the testing depth is reached, an operating power pressure increase may be added to the well bore to move the power mandrel assembly in a second opposite direction for causing the operating mechanism of the circulation valve section to operate.

In a second embodiment, a ratchet arrangement is provided which allows the volume of the compressible liquid to either expand or contract as the tool is lowered and raised in the well bore. A ratchet assembly is provided which only transmits motion in a limited area for providing operating strokes from the power mandrel assembly to the circulation valve section. When the ratchet mechanism of the assembly is on either side of this limited area, the ratchet allows relative motion between the ratchet assembly and the power mandrel assembly thereby allowing the compressible liquid to expand or contract. The ratchet assembly transmits power strokes when the ratchet assembly is in the limited area thereby transmitting incremental movement to the circulation valve section during pressure increases exerted on the well annulus.

The disclosed circulation valve section includes a holding ratchet and a pull ratchet assembly. During pulling strokes the pull ratchet assembly pulls the circulation valve section toward the open position, and the holding ratchet assembly ratchets to allow the pulling motion. When the increased annulus pressure is released, the holding ratchet assembly holds the circulation valve section operating mechanism, and the pull ratchet assembly ratchets to allow the power mandrel assembly to obtain another bite on the operating mechanism. Thus, the circulation valve section is incrementally moved toward the open position. A reciprocating allowing means is provided in both embodiments of the first mentioned ratchet to allow reciprocating motion to be transferred from the power mandrel assembly to the pull ratchet and hold ratchet assemblies of the circulation valve section operating mechanism.

A compressible liquid such as silicon oil is used to supply spring force in the disclosed apparatus. This compressible liquid may change volumes as the apparatus is lowered into the well bore, but is completely pressure balanced such that a pressure difference does not exist between the liquid spring chamber in the tool and the annulus pressure in the well annulus outside of the tubular housing. Once the testing depth is reached, power pressure increases may be applied to the fluid in the well annulus to compress the compressible liquid in the liquid spring chamber in the apparatus. The pressure increases will cause the compressible liquid to compress and will supply operating strokes to be transferred to the circulation valve section. When the well annulus pressure increases are removed, the compressible liquid will once more expand to supply a returning spring force to the operating mechanism of the circulation valve section.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly in position in a submerged well bore and extending upwardly to a floating operating and testing station.

Figure 2:
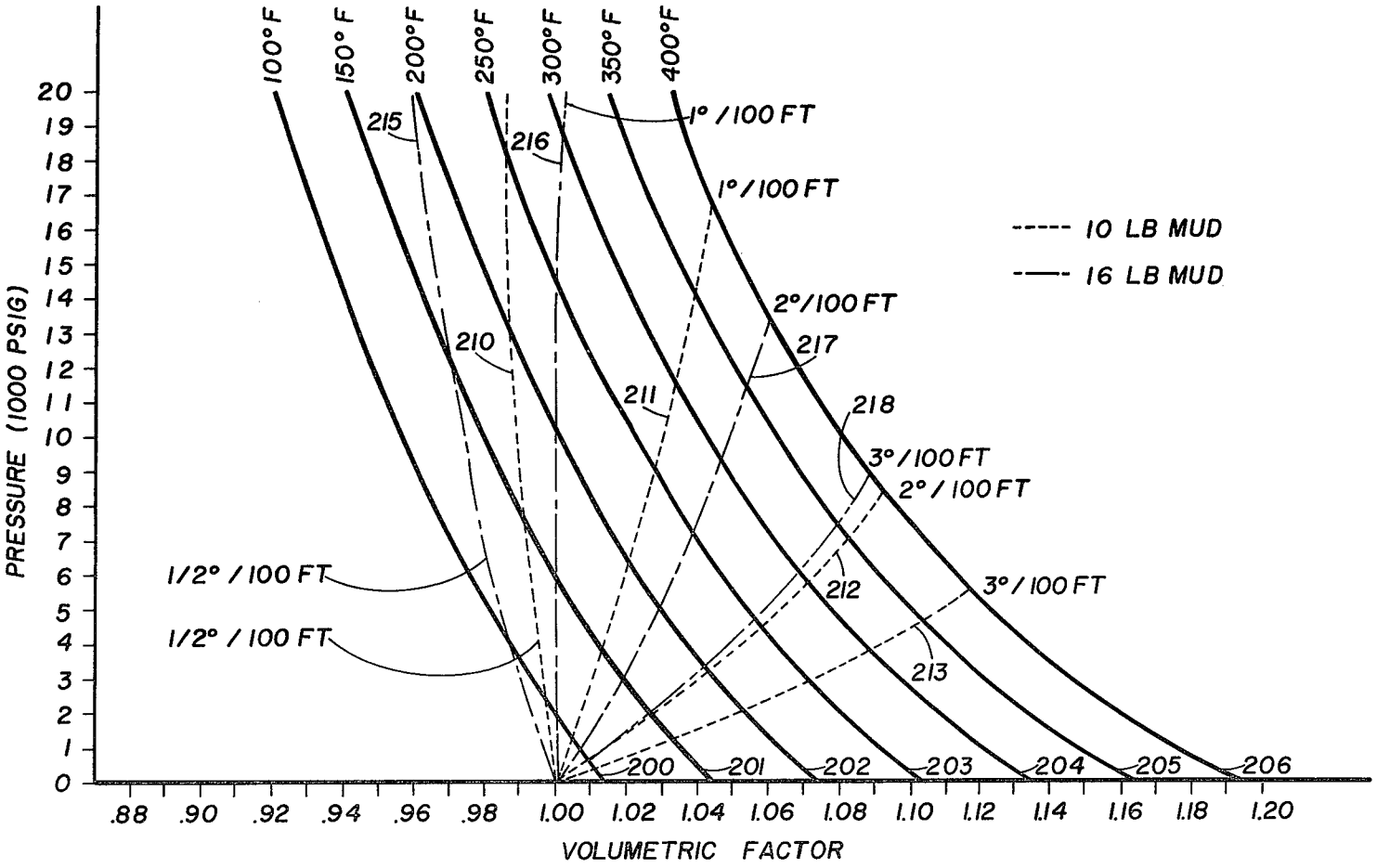
Figure 3B:
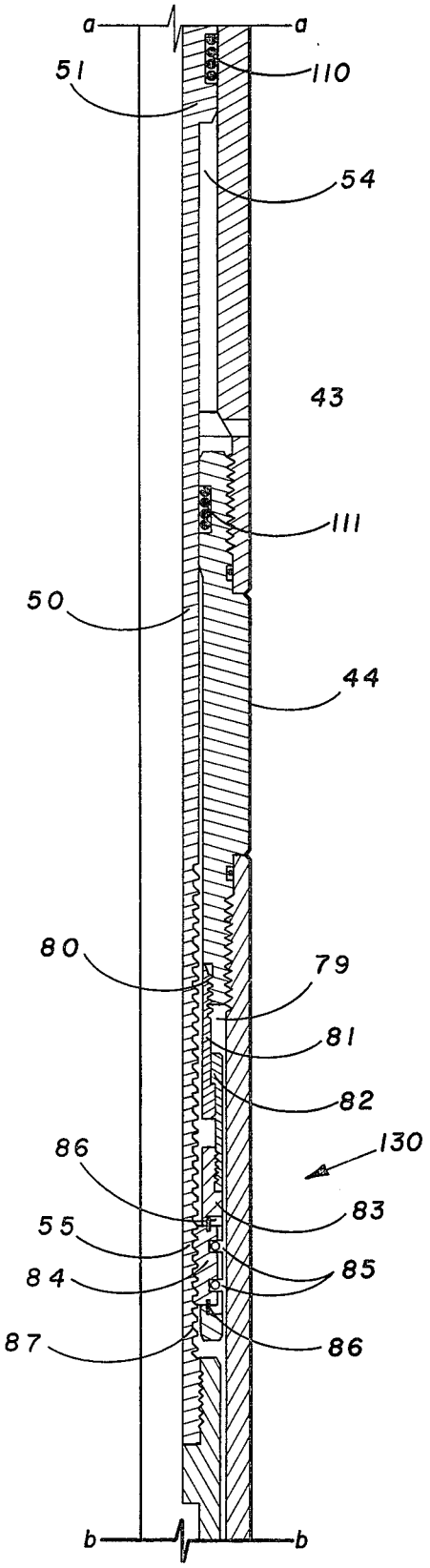
Figure 3C:
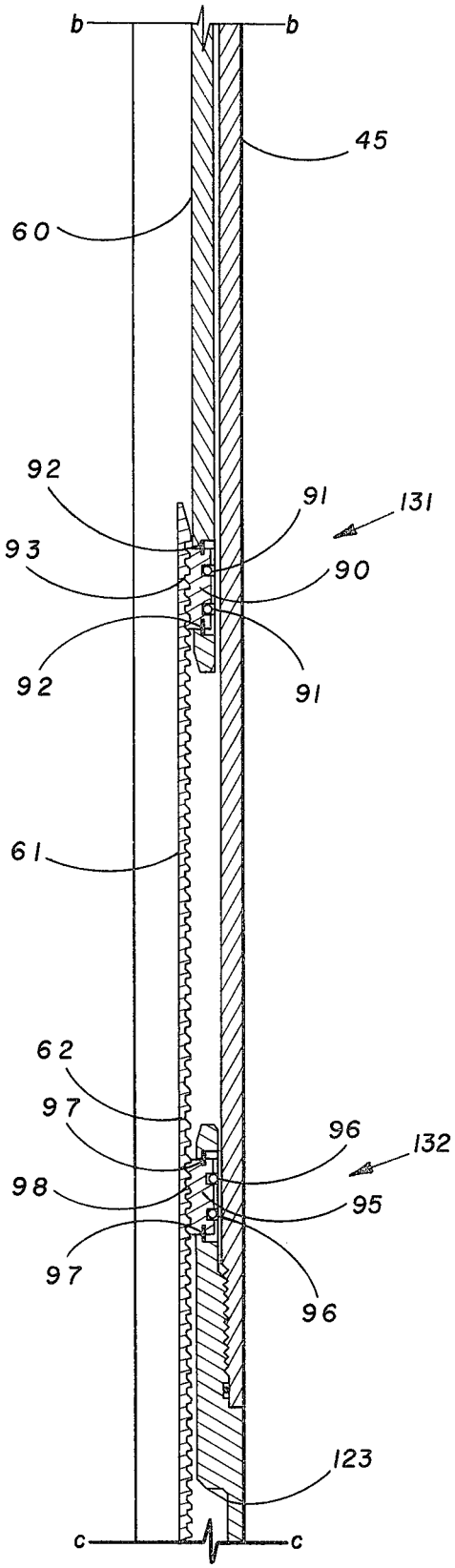
Figure 3D:
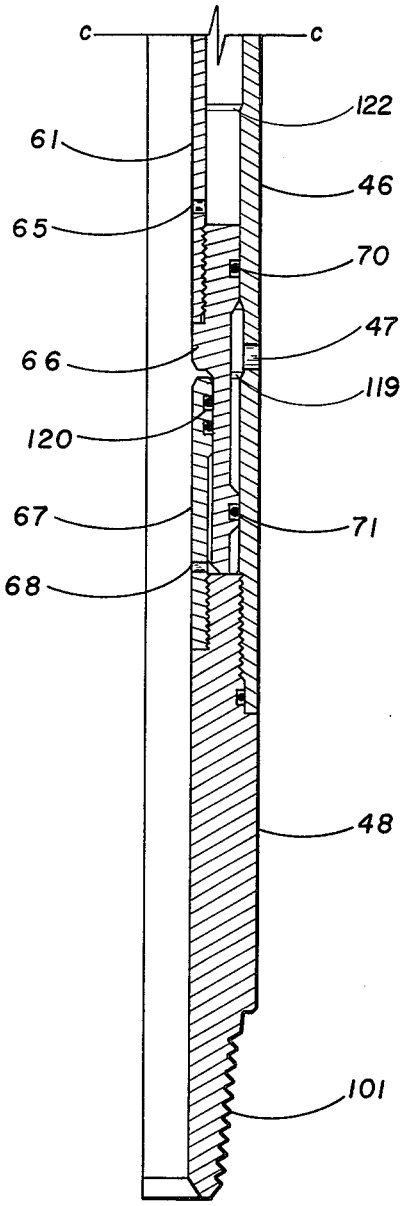

FIG. 2 provides a chart showing the volumetric factor of 20 centistoke silicon oil along the horizontal axis, and pressure in 1000 PSIG increments along the vertical axis. A family of curves shows the volume of silicon oil subjected to the temperatures and pressures indicated. Lines are also provided showing the volume of silicon oil at various pressures and temperatures experienced by the silicon oil in a well bore having specified temperature gradients and containing the indicated drilling mud weights.

FIGS. 3*a*–3*d* joined along section lines *a*—*a* through *c*—*c* illustrate one embodiment of the apparatus having a power section and a circulation valve section, and a reciprocal ratchet means for providing for expansion of the compressible liquid as the apparatus is lowered into a well bore.

Figure 4:
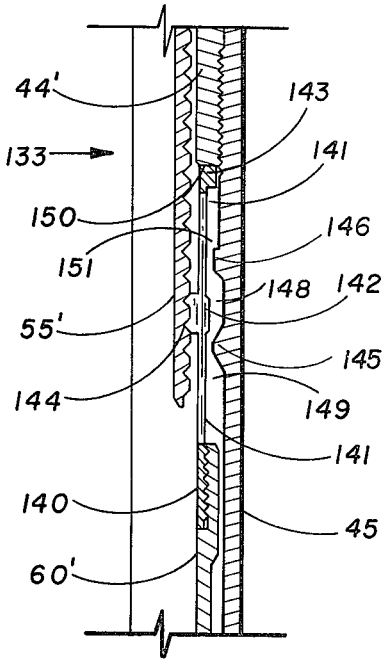

FIG. 4 shows an embodiment of a ratchet mechanism for providing the compressible liquid to both expand and contract as the apparatus is lowered and raised in the well bore.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

The annulus pressure operated method of opening and closing the tester valve, as disclosed in U.S. Pat. No. 3,664,415 issued May 23, 1972 to Wray et al. and U.S. Pat. No. 3,856,085 issued Dec. 24, 1974 to Holden et al., is particularly advantageous in offshore locations where it is desirable to the maximum extent possible, for safety and environmental protection reasons, to keep the blowout preventers closed during the major portion of the testing procedure.

The total number of pressure applications of the testing program can be counted and the tool of the present application can then be designed so that each pressure application will incrementally move the apparatus one step toward the opened condition. The disclosed circulation valve will thus not open until the testing program is complete. This concept is also disclosed in U.S. Pat. No. 3,850,250 issued Nov. 26, 1974 to Holden et al. and assigned to the assignee of the present invention.

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

A circulation valve 22 of the present invention is located near the end of the testing string 10 as shown. Also near the lower end of the formation testing string 10 below the circulation valve 22 is located a tester valve 25 which is preferably the tester valve disclosed in U.S. Pat. No. 3,856,085. As will be discussed later, each pressure application in the well annulus 16 will open the tester 25 and will move the circulation valve 22 an incremental step toward opening.

Circulation valve 22 can be designed to require a few more increments to open than the testing program requires. At the end of the program a higher pressure is applied to the annulus 16 to close and lock the tester valve 25 as is disclosed in U.S. Pat. No. 3,856,085. Additional pressure applications can then be applied to annulus 16 to open the circulation valve 22 disclosed herein.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

FIG. 2 shows the relationship between the volume of silicon oil to the pressure and temperature of the oil. The graph of FIG. 2 is for silicon oil having a kinetic viscosity of 20 centistokes. As can be seen from FIG. 2, the abscissa shows the volumetric factor of the silicon oil while the ordinate shows the pressure in thousandths of PSIG exerted on the oil. The family of curves 200 through 206 shows the volume of the silicon oil at various constant temperatures.

Also shown on the chart of FIG. 2 are curves 210 through 213 showing the absolute volume of 20 centistoke silicon oil for boreholes having various temperature gradients and filled with 10 pounds per gallon drilling mud. Likewise, curves 215 through 218 show curves for boreholes having various temperature gradients and filled with 16 pounds per gallon drilling mud.

It can be seen that 20 centistoke silicon oil expands as the pressure and temperature increases with depth in a well bore as a tool containing the silicon oil is lowered in a well bore having a temperature gradient of 1° per 100 feet or higher. This is true for the lighter drilling muds as shown by line number 211 or 10 pounds per gallon mud, and also for heavier drilling mud as shown by the line 216 for 16 pounds per gallon mud.

FIG. 2 was developed from theoretical values of the bulk moduli of 20 centistoke silicon oil having an initial pressure and temperature of 0 PSIG and 77° F., respectively, from the paper, "A Correlation of Bulk Moduli and P-V-T Data for Silicon Fluids at Pressures up to 500,000 PSIG" by John A. Tichy and Ward O. Winer, ASLE Transactions 11, 333–344 (1968). These values for lines 200, 201 and 202 were verified by experimental data up to about 11,000 PSIG. Lines 210 through 213 and lines 215 through 218 were plotted using the theoretical bulk moduli of 20 centistoke silicon oil for the various temperature gradients indicated. Ten pounds per gallon mud was chosen as approximately the lightest drilling fluid used in the industry and 16 pounds per gallon mud was chosen as approximately the heaviest drilling fluid presently used.

THE PREFERRED EMBODIMENTS

FIGS. *3a–3d* show a right side only sectioned view of one of the preferred embodiments of the present invention. The circulation valve 22 has an open bore 40 which communicates with the open interior bore of the testing string 10 above and below the apparatus 22. The tool 22 includes an outer housing assembly composed of an upper housing adapter 41, a power section housing 42 having a power port 43, an intermediate housing 44, a ratchet section housing 45, a circulating valve housing 46 having circulating port 47, and a lower housing adapter 48.

Adapter 41 is considered to be the upper end of the apparatus 22, and adapter 101 is considered to be the lower end. It will be understood that the apparatus 22 could be turned over without affecting its operation.

Slidably located in the open bore of the outer housing assembly is a tubular mandrel assembly composed of a power mandrel 50, having mounted thereon a power piston 51. The power piston 51 moves back and forth in an annular space 54 provided between the power mandrel 50 and the power section housing 42 by a thickened portion 53 of the power housing 42 as shown. Seals 116 are provided in the power piston 53 to prevent liquid from escaping past power piston 51.

A differential area is provided by seals 111 provided between a portion of the intermediate housing 44 and the power mandrel 50 as shown. Seals 110 and 111 provide that drilling mud which enters chamber 54 through power port 43 will be exposed to one side of power piston 51 to move power mandrel 50 with changes in the hydraulic pressure of the fluid in the well annulus 16.

On the other side of power piston 51 is a chamber 52 between the power mandrel 40 and the power section housing 42 as shown in FIG. *3a*. This chamber is filled with silicon oil which is retained in the chamber 52 by seals 110 in the power mandrel 51 and by seals 112 between the upper housing adapter 41 and the power mandrel 50 as shown in FIG. *3a*. It can thus be seen that if pressure increases in the well annulus 16 to move power piston 51 and its connected power mandrel 50 toward the silicon oil, then the silicon oil contained in chamber 52 will be compressed. Likewise, if the volume of silicon oil in the chamber 52 expands, then the power piston 51 and its connected power mandrel 50 will be moved toward the power port 43.

A toothed portion 55 of power mandrel 50 is connected to a pull mandrel 60 as shown in FIG. *3b*. Pull mandrel 60 is connected by a ratchet assembly 131 to a ratchet mandrel 61. The ratchet assembly 131 will be discussed later. Ratchet mandrel 60 also is connected to ratchet assembly 132, also to be discussed later.

Ratchet mandrel 61 includes a hydraulic port 65 as shown in FIG. *3d* to prevent hydrostatic lock-up as the circulating valve is moved from the closed to the open position.

A circulation port mandrel 66 is connected to ratchet mandrel 61 to selectively block circulation port 47 in the closed position, and to unblock circulation port 47 in the open position. This circulation port mandrel 66 is located between the circulation valve housing 46 and an extension 67 of the lower adapter 48 as shown in FIG. *3d*. A port 68 is provided in the adapter extension 67 to prevent hydrostatic lock-up as the valve mandrel 66 is moved from the closed position to the open position, and to provide an opening force to mandrel 66 when the port 47 is first unblocked. The circulation port 47 is sealed in the closed position by an upper seal 70 and a lower seal 71 in the valve mandrel 66 as shown.

An enlarged portion 119 is provided in the circulation valve housing 46 as shown such that after a certain predetermined upward movement of the circulation valve mandrel 66 the seals 171 enter the enlarged portion 119 to allow annulus pressure to be applied through port 47 and around seal 71 to the free end of circulation valve mandrel 66. Seals 120 are provided between the extension 67 and the valve mandrel 66 as shown in FIG. *3d*. It can thus be seen that when the valve mandrel 66 moves toward the open position a predetermined distance, the seals 71 become ineffective and the annulus pressure through port 47 and around said seals 71 provide an opening force to the bottom of circulation valve mandrel 66 between seals 120 and 70. This opening force causes the valve mandrel 66 to move toward the open position as soon as seals 71 have moved the mentioned predetermined distance. Holding ratchet assembly 132 prevents circulation valve mandrel 66 from reclosing after it has been moved to the open position.

Also shown in FIG. *3d* is enlarged portion 122. The distances are designed to ensure that seal 71 moves into enlarged portion 119, and that an opening force is created before seal 70 moves into enlarged portion 122.

This distance ensures that an initial opening momentum is established before a circulation path is provided around seals 70 by enlarged portion 122. The purpose of enlarged portion 122 is to reduce friction between seal 70 and housing section 46 so that the circulation valve mandrel 66 may move toward the open position unimpeded by this friction.

The apparatus 22 disclosed in FIGS. *3a–3d* contains three ratchet assemblies; namely, a reciprocal ratchet assembly 130, a pull ratchet assembly 131, and a holding ratchet assembly 132. The design of these ratchet assemblies are well known in the oil well testing circulation valve art and are shown, for instance, in U.S. Pat. No. 3,850,250 issued Nov. 26, 1974 to Holden et al. and assigned to the assignee of the present invention.

The reciprocal ratchet assembly 130 provides for the silicon oil in chamber 52 to expand while allowing incremental pulling motion of pull mandrel 60. The reciprocal ratchet assembly 130 includes interconnecting pieces 81 and 82 which are located between the ratchet mandrel 87 and the intermediate housing 45 to allow back and forth or reciprocal movement between the two pieces 81 and 82. Piece 81 is connected to the intermediate housing 44 by threaded joint 80. A reciprocal ratchet mandrel 83 is connected to piece 82 and includes windows in which are located ratchet blocks 84. These ratchet blocks are biased inwardly by coil springs 85 as shown in FIG. *3b*. The ratchet blocks 84 are held in the windows in the ratchet mandrel 83 by retaining pins 86.

Ratchet blocks 84 and power mandrel portion 55 include interconnecting ratchet teeth 87. These ratchet teeth are designed to allow the power mandrel 50 to move in one direction, and to hold to prevent movement of mandrel 50 in the opposite direction. Area 79 between piece 82 and intermediate housing 44 is provided to allow the reciprocating ratchet assembly 130 to move back and forth during pressure changes in the well annulus 16. Thus it can be seen that when pressure is applied in the annulus 16, it communicates with power piston 51 through the power port 43. This pressure application serves to compress the silicon oil in chamber 52 and allows power mandrel 50 to move in a power stroke. During the movement provided by these power strokes, reciprocating ratchet assembly 130 may move a distance equal to the travel provided in area 79.

Referring to FIG. 2, it can be seen that the volume of the silicon oil of the chart will increase when it is lowered into a well bore having at least a 1° F./100 feet temperature gradient and containing at least 10 pound mud. This increasing volume will move pieces 81 and 82 to their extended position as shown in FIG. *3b*. Any further increase in volume as the apparatus is lowered into the well bore will cause toothed portion 55 of power mandrel 50 to ratchet downwardly past reciprocal ratchet assembly 130.

Pressure increases applied at testing depth to the well annulus 16 by pump 15 will cause power mandrel 50 to move upwardly. This upward movement of power mandrel 50 will produce relative movement between the pieces 81 and 82 to allow reciprocal ratchet assembly 130 to move upwardly by the action of ratchet teeth 87. Thus, power strokes are transferred from power mandrel 50 to pull mandrel 60. Releasing of the pressure increases in well annulus 16 will allow the silicon oil in chamber 52 to expand, and will cause relative movement between pieces 81 and 82 until they are again in the expanded position shown in FIG. *3b*.

At one end of pull mandrel 60 is pull ratchet assembly 131. Assembly 131 includes ratchet blocks 90 in windows provided in the mandrel 60. The blocks 90 are biased inwardly by coil springs 91 as shown in FIG. *3c*. The ratchet blocks 90 are held in the windows in pull mandrel 60 by retaining pins 92 as shown.

Ratchet blocks 90 and ratchet mandrel 61 include interconnecting ratchet teeth 93. These teeth are designed to allow the ratchet blocks 90 to move freely in a first, downward direction as the silicon oil in chamber 52 expands, but to hold and pull the ratchet mandrel 61 when the power mandrel 50 and pull mandrel 60 move in the opposite direction during the power stroke.

The apparatus 22 is also provided with a holding ratchet assembly 132 shown in FIG. *3c*. This holding ratchet assembly 132 includes an extension 49 of circulation valve housing 46. In windows of the extension 49 are ratchet blocks 95 for preventing movement of the ratchet mandrel 61 in a first, downward direction, while allowing the ratchet mandrel 61 to move in the opposite direction.

Ratchet blocks 95 are biased inwardly by coil springs 96 as shown in FIG. *3c*. The ratchet blocks are held in windows in the extension 49 by retaining pins 97.

Interconnecting teeth 98 are provided in the ratchet blocks 95 and the ratchet mandrel 61 as shown. It will be noticed that the ratchet teeth 93 and ratchet teeth 98 which appear on ratchet mandrel 61 are a continuous set of ratchet teeth. The upward edge to this set of teeth is slanted and the lower edge of the teeth are squared such that as pull mandrel 60 is pushed downwardly, the teeth urge blocks 90 outwardly to allow relative movement of the blocks 90 and the mandrel 61. During this downward movement, teeth 98 will lock to hold mandrel 61 such that there cannot be relative movement between mandrel 61 and blocks 95, and thus ensures that mandrel 61 will not move downward.

During the power stroke in which the silicon oil in chamber 42 is compressed, the pull mandrel 60 pulls the pull ratchet assembly 131 in the opposite, upward direction; and holding ratchet assembly 132 allows ratchet mandrel 61 to move upwardly. Thus the circulation valve mandrel 66 is incrementally moved from a closed position blocking circulation port 47 to an open position opening port 47 to the apparatus bore 40.

The apparatus 22 is fitted into the testing string 10 by the use of threads 100 in upper adapter 41, and threads 101 in lower adapter 48. Again, it will be understood by those skilled in the art that either end of the apparatus 22 may be in the upper position with respect to the other in the testing string 10.

A split ring ratchet assembly 133 such as that shown in FIG. 4 may be substituted for the ratchet block type reciprocal ratchet assembly 130 shown in FIG. *3b*. In FIG. 4, 55' is the lower portion of the power mandrel 50, 44' is the intermediate housing, and 45' is the ratchet housing. The pull mandrel is represented by 60'.

It will be noted that the lower portion of the power mandrel 55' is not connected directly to the pull mandrel 60'.

A split ring ratchet mandrel 140 is connected directly to one end of the pull mandrel 60'.

The split ring ratchet mandrel 140 is provided with a plurality of ratchet arms 141 and the arms are provided with ratchet heads 142. An end ring 143 terminates the arms 141 of the split ring ratchet assembly 133. It can be seen that end ring 143 is free to move between a thickened portion 146 of the ratchet housing 45' and the downward facing surface 150 of intermediate housing extension 44'.

Interconnecting ratchet teeth 144 are provided on the lower portion of pull mandrel 55' and the ratchet head 142. It will be noticed that the ratchet teeth 144 are slanted on both sides such that some longitudinal force is passed between the ratchet head 142 and the lower portion of the pull mandrel 55' until a predetermined resistance is met. The slanted faces of the ratchet teeth 144 then bias the ratchet arms 141 outwardly to cause the ratchet head 142 to allow the lower portion of the pull mandrel 55' to move past the ratchet head 142.

This relative movement occurs except if the ratchet head is under the thickened portion 145. Thus the thickened portion 145 provides that the lower portion of the pull mandrel 55 and the ratchet head 142 are securely fastened together while ratchet head 142 is under the thickened portion 145.

An enlarged ratchet area 148 is provided in the ratchet housing 45' on one side of the thickened portion 145 and an enlarged ratchet area 149 is provided in ratchet housing 45' on the other side of thickened portion 145.

Area 151 is dimensioned such that end ring 143 may move between downward directed face 150 and thickened portion 146 a predetermined distance.

It can thus be seen that the split ring ratchet assembly 133 may be used in either a relatively hot or cold well. If the well is one of those illustrated in the graph of FIG. 2 by line 215 where the volume of the silicon oil decreases as the testing string is lowered into the well, the split ring ratchet assembly 133 will move to the collapsed position wherein terminal ring 143 abuts face 150. The ratchet heads 142 will then be biased outwardly by teeth 144 into area 148 to allow mandrel portion 55' to continue to move upwardly as the volume of the silicon oil in chamber 52 continues to decrease.

On the power stroke, the increased well annulus pressure will further decrease the volume of silicon oil and allow split ring ratchet assembly 133 to ratchet futher as described. When the annulus pressure increase is removed, the mandrel portion 55' as shown in FIG. 4 will move downwardly and thus also push ratchet heads 142 to the right under enlarged portion 145. With mandrel portion 55' and ratchet heads 142 thus connected together, push mandrel 60' is then pushed downwardly to take an incremental bite of the circulation valve opening mechanism described in relation to FIG. 3*c*.

If the downward motion continues due to expanding silicon oil, the downward movement of the pull mandrel 60' will be limited by terminal ring 143 moving to the other end of area 151 such that terminal ring 143 abuts against enlarged portion 146. In this position, heads 142 are in enlarged area 149 and are moved outwardly by the action of teeth 144 thus allowing mandrel portion 55' to ratchet past the heads 142 in the downward direction. In this way the size of the incremental bite is limited.

Subsequent power strokes will then incrementally pull the circulation mandrel 66 to the open position as the ratchet heads 142 pass under the enlarged portion 145 with each power stroke.

The split ring ratchet assembly 133 of FIG. 4 can also be used where the volume of the silicon oil increases as the testing string is lowered into the well. As the volume of silicon oil in chamber 52 expands, the power mandrel portion 55' as illustrated in FIG. 4 will move to the right. This movement will expand the ratchet assembly 133 until terminal ring 143 is abutted against enlarged portion 146. Further expansion of the silicon oil in chamber 52 will cause the ratchet heads 142 to ratchet in area 149 and thereby allow portion 55' of power mandrel 50 to continue moving to the right under the influence of the expanding silicon oil in chamber 52.

During a power stroke, the ratchet head 142 will be pulled under enlargement 145 to cause the operating mechanism of the circulation valve to incrementally open the circulation port 47. The incremental movement of the circulating valve opening mechanism is determined by the size of area under enlargement 145.

It can thus be seen that as an apparatus containing the ratchet assembly 133 of FIG. 4 is lowered into a well, that very little, if any, pressure differential will develop across power piston 51. The ratchet assembly 133 will allow the silicon oil to either expand or contract depending on the temperature and pressure gradient of the particular well being tested. The ratchet mandrel 141 can be initially placed in the expanded or contracted position depending on the expected temperature gradient.

An alternate method of use on the ratchet assembly 133 would be to provide for one more incremental movement to open the circulation valve than is needed to allow one initial incremental movement of the pull mandrel 60' as the tool is lowered into the well. Such a method would also allow for the silicon oil to either expand first and then contract, or to contract first and then expand as, for instance, if the ambient air temperature was either colder or hotter than the well temperature at the surface.

The two way ratchet action of assembly 133 of FIG. 4 also allows the volume of the silicon oil to change as the testing string is removed from the well. This is not true of the one way ratchet action of assembly 131 of FIG. 3.

The ratchet teeth 87, 93 and 98 of FIG. 3 and ratchet teeth 144 of FIG. 4 are preferably designed such that the valve mandrel 66 is not moved due to pressure increases as the tool 22 is lowered quickly with a new stand of drill pipe before the increased temperature of the deeper depth can heat the silicon oil.

It is also desirable to protect both embodiments of tool 22 from temperature changes while the tool is at the surface, or to not add the silicon oil to chamber 52 until just before use of the tool. If this method is not followed it is possible that successive changes in the ambient air temperature may incrementally ratchet the circulation valve to the open or partially open position.

The preferred silicon oil for both embodiments disclosed is Dymethyl Silicon Fluid having the characteristics of 1,000 centistoke silicon oil manufactured by General Electric Company as TYPE SF-96 (1,000) or Dow Chemicai Company as TYPE 200 (1,000).

Turning again to FIG. 2, it can be seen that when the silicon oil of the chart is introduced into a well bore having a 3° F/100 feet temperature gradient and filled with 10 pound mud, and lowered to the point where the silicon oil is heated to 300° F, the silicon oil will be subjected to 3850 PSIG pressure and have a volumetric factor of about 1.09. These conditions would represent a well about 7400 feet deep.

If a power pressure of 1000 PSIG is added to the well annulus, the silicon oil of the chart will compress about 1%, as shown by line 204, until the volumetric factor of the silicon oil is about 1.08. If, for instance, the power piston 51 in power chamber 54 has a cross-sectional area of 3.25 square inches, and the incremental travel needed for each power stroke is ⅝ of an inch, the 1000 PSI power stroke will reduce the silicon oil 2.03 cubic inches which is 1% of 203 cubic inches or 0.879 gallons.

Thus, the volume of silicon oil chamber 52 must be at least 203 cubic inches to meet these conditions. Likewise, the volume of chamber 52 may be designed to have sufficient capacity for the conditions of the well in which the apparatus 22 is to be used. One skilled in the art may vary the capacity of chamber 52 by changing the power pressure increases, the cross-sectional area of piston 51, or the silicon oil used in the chamber 52.

Sufficient travel may be designed into the apparatus such that the power mandrel may operate other well valves such as a tester valve.

The foregoing disclosure is intended to be illustrative only and is not intended to cover all embodiments that may occur to one skilled in the art to accomplish the foregoing objectives. Other embodiments which work equally well and are equivalent to the embodiments shown may be imagined by one skilled in the art. The attached claims are intended to cover the embodiments disclosed as well as such equivalent embodiments of the invention which may occur to one skilled in the art.

What is claimed is:

1. A valve apparatus for use in an oil well having pressure and temperature gradients from the surface to a formation intersected by the well bore comprising:

a housing having a power port through the walls thereof and a central bore longitudinally therethrough;

a power mandrel assembly in said central bore and arranged in said housing for forming a sealed chamber between said housing and said power mandrel assembly;

a power piston dividing said chamber and exposed to pressure in said chamber on one side and the well bore pressure transmitted through said power port on the other side;

compressible liquid in said sealed chamber for providing operating spring force to said power piston, the volume of said liquid changeable with the pressure and temperature gradients as the apparatus is lowered into a well bore;

first means between said housing and said power mandrel assembly for allowing the volume of said compressible liquid to change as the apparatus is lowered into said well bore; and valve operating means in said first means and operably connected to said power mandrel assembly for operating a valve in the oil well responsive to pressure changes in the well annulus after said apparatus has been lowered into said well bore.

2. The valve apparatus of claim 1 wherein said first means comprises a ratchet means for allowing said power mandrel assembly to move freely in a first longitudinal direction responsive to an increase in volume of said compressible liquid as the apparatus is lowered into a well bore, and for transmitting movement to said valve operating means as said power mandrel assembly moves in a second longitudinal direction responsive to well annulus pressure increases after said apparatus has been lowered into said well bore.

3. The valve apparatus of claim 2 wherein said valve operating means includes means for moving a valve from a first position to a second position after a predetermined number of movements of said power mandrel assembly in said second longitudinal direction.

4. The valve apparatus of claim 1 wherein said first means has a first zone wherein movement occurs between said power mandrel assembly and said valve operating means, a second zone wherein movement is transmitted from said power mandrel assembly to said valve operating means, and a third zone wherein movement occurs between said power mandrel assembly and said valve operating means: and said first means further comprises;

interconnecting means between said first means and said power mandrel assembly for transmitting movement of said power mandrel assembly to said valve operating means when said first means is in said second zone, and means on said interconnecting means for moving said first means from one of said first and third zones to said second zone as said power mandrel assembly moves responsive to oil well annulus pressure changes.

5. The valve apparatus of claim 4 further comprising limiting means in said first means for limiting movement of said first means at the ends of said first and third zones as compared with the movement of said power mandrel assembly responsive to an operating pressure change in the well annulus pressure.

6. The valve apparatus of claim 5 wherein said valve operating means includes means for moving a valve from a first position to a second position after a predetermined number of movements transferred from said power mandrel assembly through said first means to said valve operating means.

7. A method of operating a valve apparatus in an oil well having temperature and pressure gradients from the surface to a formation intersected by a well bore comprising:

providing the apparatus with a compressible liquid whose volume is changeable with the pressure and temperature gradients from the surface to the well formation;

subjecting the liquid to a piston exposed on one side to the liquid and on the other side to the pressure external from the valve apparatus;

lowering the apparatus into a well bore;

allowing the piston to move with a change in the volume of the liquid as the apparatus is lowered into the well bore;

after the apparatus has reached a desired depth, exerting a pressure increase on fluid in the well bore;

moving said piston and compressing said liquid responsive to said pressure increase;

transferring movement of said piston responsive to the pressure increase to means for operating a valve in the well bore.

8. The method of claim 7 wherein the transferring movement of said piston step comprises:

providing transferring means having a first zone wherein said piston is allowed to move without transferring motion to said valve operating means, a second zone wherein motion of said piston is transferred to said valve operating means, and a third zone separated from said first zone by said second zone wherein said piston is allowed to move without transferring motion to said valve operating means; and moving said transferring means between said first and third zone through said second zone for transferring movement of said piston to said valve operating means while said transferring means is in said second zone.

9. An oil well circulation valve of the type which moves incrementally from the closed to the opened position responsive to pressure increases in the well annulus comprising:

a tubular housing;

a tubular power mandrel in and axially aligned with a portion of said tubular housing and having a power piston thereon responsive to pressure changes in the well annulus;

said housing and said power mandrel having a sealed chamber therebetween for holding a compressible liquid, said power piston dividing said chamber and arranged to compress said liquid when said power mandrel moves in a first direction responsive to pressure increases in the well annulus, and further arranged to move said power mandrel in a second opposite direction when said liquid expands responsive to pressure decreases in said well annulus and to temperature increases of said compressible liquid;

means for allowing said power mandrel to move in the second direction responsive to the expansion of liquid in said chamber during the lowering of the circulation valve into the well;

means for limiting to a predetermined distance the movement of said power mandrel relative to said housing in the first direction during pressure changes in the well annulus; and valve means in said tubular housing responsive to movement of said power mandrel for opening a flow path between the interior of the circulation valve and the well annulus after a set minimum number of back and forth reciprocal movements of said power mandrel in said housing.

10. The valve of claim 9 wherein said means for allowing said power mandrel to move responsive to expansion of liquid in said chamber comprises a ratchet between said power mandrel and said valve means which allows said power mandrel to move freely in the second direction without transferring movement to said valve means, and which operably connects said power mandrel to said valve means when said power mandrel moves in the first direction for transferring movement from said power mandrel to said valve means for activating said valve means.

11. An oil well circulation valve of the type which moves incrementally from the closed to the opened position responsive to pressure increases in the well annulus comprising:

a tubular housing;

a tubular power mandrel in and axially aligned with a portion of said tubular housing and having a power piston thereon responsive to pressure changes in the well annulus;

said housing and said power mandrel having a sealed chamber therebetween for holding a compressible liquid, said power piston dividing said chamber and arranged to compress said liquid when said power mandrel moves in a first direction responsive to pressure increases in the well annulus, and further arranged to move said power mandrel in a second opposite direction when said liquid expands responsive to pressure decreases in said well annulus and to temperature increases of said compressible liquid;

transferring means operatively connected to one end of said power mandrel movable between a first zone wherein movement of said power mandrel is not transferred through said transferring means, a second zone wherein movement of said power mandrel is transferred through said transferring means, and a third zone separated from said first zone by said second zone wherein movement of said power mandrel is not transferred through said transferring means; and valve means in said tubular housing responsive to movement of said power mandrel transferred through said transferring means for opening a flow path between the interior of the circulation valve and the well annulus after a set minimum number of back and forth reciprocal movements of said power mandrel between said first and third zones through said second zone of said transferring means.

12. The circulation valve of claim 11 wherein said transferring means comprises:

expanding means connected to said valve means for activating said valve means, said expanding means being slidably movable between said first and third zones through said second zone;

interconnecting means between said power mandrel and said expanding means and engageable when said expanding means is in the unexpanded position for selectively connecting said power mandrel to said expanding means; and means in said transferring means for preventing expansion of said expanding means when said expanding means is in the second zone of said transferring means for engaging said interconnecting means and selectively connecting said expanding means to said power mandrel when said expanding means is in the second zone.

13. The circulation valve of claim 12 further comprising limiting means in said transferring means for limiting the slidable movement of said expanding means to an amount less than the movement of said power mandrel when said power mandrel is moved responsive to operating pressure changes in the well annulus.

14. The circulation valve of claim 12 wherein said expanding means comprises:

two spaced apart rings;

a plurality of spring arms longitudinally between said rings having each end of said spring arms connected to one of said rings; and a ratchet head on selected ones of said spring arms for being moved radially outwardly by said spring arms away from said power mandrel when said ratchet head is in one of the first and third zones of said transferring means, and for being urged radially inwardly toward said power mandrel by said means for preventing expansion when said ratchet head is in the second zone of said transferring means.

15. The circulation valve of claim 14 wherein said interconnecting means comprises interconnecting slanted teeth on said power mandrel and said ratchet head for biasing said ratchet head radially outwardly when said ratchet head is in one of the first and third zones of said transferring means, and for engaging and selectively connecting said ratchet head to said power mandrel when said ratchet head is in the second zone of said transferring means.

* * * * *